US009937540B2

(12) United States Patent
Braun et al.

(10) Patent No.: US 9,937,540 B2
(45) Date of Patent: Apr. 10, 2018

(54) PIERCING MANDREL HAVING AN IMPROVED SERVICE LIFE FOR PRODUCING SEAMLESS TUBES

(71) Applicant: Vallourec Deutschland GmbH, Düsseldorf (DE)

(72) Inventors: Winfried Braun, Düsseldorf (DE); Christian Klempel, Mülheim an der Ruhr (DE); Rene Baadjou, Gangelt (DE); Rolf Kümmerling, Duisburg (DE)

(73) Assignee: Vallourec Deutschland GmbH, Düsseldorf (DE)

( * ) Notice: Subject to any disclaimer, the term of this patent is extended or adjusted under 35 U.S.C. 154(b) by 0 days.

(21) Appl. No.: 14/917,371

(22) PCT Filed: Sep. 22, 2014

(86) PCT No.: PCT/EP2014/070153
§ 371 (c)(1),
(2) Date: Mar. 8, 2016

(87) PCT Pub. No.: WO2015/044094
PCT Pub. Date: Apr. 2, 2015

(65) Prior Publication Data

US 2016/0346820 A1 Dec. 1, 2016

(30) Foreign Application Priority Data

Sep. 27, 2013 (DE) ..... 10 2013 110 725

(51) Int. Cl.
*B21B 25/00* (2006.01)

(52) U.S. Cl.
CPC ..... *B21B 25/00* (2013.01)

(58) Field of Classification Search
CPC ..... B21B 25/00; B21B 25/04; B21B 26/06; B21B 17/02; B21B 17/08; B21C 3/16
See application file for complete search history.

(56) References Cited

U.S. PATENT DOCUMENTS 1,374,369 A 4/1921 Luther
2,197,098 A 4/1940 Davis et al.
(Continued)

FOREIGN PATENT DOCUMENTS

CN 2887480 Y 4/2007
CN 202061979 U 12/2011
(Continued)

OTHER PUBLICATIONS

International Search Report of the International Searching Authority from corresponding Patent Cooperation Treaty (PCT) Application No. PCT/EP2014/070153.
(Continued)

*Primary Examiner* — Teresa M Ekiert
(74) *Attorney, Agent, or Firm* — Gardner, Linn, Burkhart and Ondersma LLP

(57) ABSTRACT

A piercing mandrel for piercing heated round blocks of metal for the production of seamless pipes, having a piercing mandrel nose and a piercing mandrel main body which can be connected to a mandrel bar. The outer diameter of the piercing mandrel nose is formed in a conically tapering manner in the longitudinal direction towards the piercing mandrel main body in order to increase the durability of the piercing mandrel when used for piercing round blocks of metal, in particular higher-alloyed steel materials which are difficult to work, by means of skew rolling providing a qualitative improvement of the inner surface of the pierced round block and reducing tool costs.

18 Claims, 3 Drawing Sheets

(56) References Cited

U.S. PATENT DOCUMENTS

| | | | | | |
|---|---|---|---|---|---|
| RE21,957 | E | * | 11/1941 | Kelso | B21B 25/04 72/209 |
| 2,261,937 | A | | 11/1941 | Kelso | |
| 4,311,032 | A | * | 1/1982 | Nessi | B21B 25/02 72/208 |
| 4,393,677 | A | * | 7/1983 | Tamura | B21B 19/04 72/209 |
| 4,406,143 | A | * | 9/1983 | Patula | B21B 17/12 72/209 |
| 4,712,407 | A | * | 12/1987 | Yoshiki | B21C 1/24 72/68 |

FOREIGN PATENT DOCUMENTS

| | | | | | |
|---|---|---|---|---|---|
| DE | 2945620 | A1 | * | 6/1981 | B21C 1/24 |
| DE | 19636321 | C1 | | 11/1997 | |
| DE | 10024246 | A1 | | 11/2001 | |
| EP | 2404680 | A1 | | 1/2012 | |
| EP | 1961497 | B1 | | 6/2013 | |
| GB | 266918 | A | * | 3/1927 | B21D 22/16 |
| JP | 03204106 | A | | 9/1991 | |

OTHER PUBLICATIONS

Preliminary Report on Patentability of the International Searching Authority in English from corresponding Patent Cooperation Treaty (PCT) Application No. PCT/EP2014/070153, dated Mar. 29, 2016.

* cited by examiner

PIERCING MANDREL HAVING AN IMPROVED SERVICE LIFE FOR PRODUCING SEAMLESS TUBES

CROSS REFERENCE TO RELATED APPLICATION

The present application claims the priority benefits of International Patent Application No. PCT/EP2014/070153, filed on Sep. 22, 2014, and claims benefit of DE 10 2013 110 725.7, which are hereby incorporated herein by reference in their entireties.

BACKGROUND OF THE INVENTION

The invention relates to a piercing mandrel for piercing heated round blocks of metal for the production of seamless pipes, having a piercing mandrel nose and a piercing mandrel main body which can be connected to a mandrel bar.

It is generally known that seamless pipes are produced by means of a method, in which starting material which is cylindrically formed and heated in a rotary hearth furnace, so-called round blocks, is formed in a piercing mill using an axially fixed inner tool consisting of a piercing mandrel and a mandrel bar to produce a pipe-shaped hollow block.

In order to form a seamless hollow block pipe, after being grasped by the piercing mill the block is transported in helical line fashion through the piercing mill and thus over the axially fixed inner tool and in the subsequent course of the method is wall-ironed to form a seamless pipe. The hole is produced by virtue of the fact that the round block is advanced by the skewed rollers and is urged over a piercing mandrel. The piercing mandrel itself typically has a diameter which increases continuously starting from the tip.

The piercing mandrel which typically consists of a highly heat-resistant tool steel not only has the task of actual piercing but also the task of welding any material fractures, smoothing the inner surface of the resulting hollow block and bringing the wall thickness thereof to the desired dimension in the most uniform manner possible.

Since the piercing mandrel has to perform its work under the influence of rolling heat, it is subject to extreme loadings and only has a limited service life. Since the invention of the skew rolling method, efforts have been made to extend the service life of the rolling mandrels, to save costs and to improve the quality of the rolled pipes. If the piercing mandrel, which is also referred to as a rolling mandrel, is coming to the end of its tool life, the piercing mandrel can also lose its shape and its surface can become damaged or the material thereof can become fractured. At the same time, this also signifies a deterioration in pipe quality, in particular by reason of defects on the inner surface of the hollow block and a non-uniform wall thickness.

In this case, particular problems are posed by pipe materials which are difficult to work, such as chromium-containing materials, having more than 5 wt. % chromium, which place particular thermal and mechanical loadings upon the piercing mandrel and in particular the mandrel tip, so that even after a small number of piercing procedures the mandrel tip has traces of wear which quickly lead to detrimental changes in the geometry of the mandrel and thus to internal defects and geometry deviations in the hollow block.

Over the course of time, many measures have been proposed which were intended to reduce heat introduction into the mandrel and increase the durability. Examples of this include the production of piercing mandrel tips from particularly heat-resistant materials, such as e.g. engineering ceramics, the coating of the piercing mandrel surface with additional materials, controlled oxidation of the surface, frequent replacement of the mandrels in conjunction with water-spray and immersion cooling, and internal cooling of the piercing mandrels with water through the mandrel bar. An overview of the prior art is provided in Japanese laid-open document JP 03204106 A, German patent specification DE 196 36 321 C1 and European laid-open document EP 2 404 680 A1.

In order to improve the durability of the piercing mandrel and to avoid internal defects in the hollow block, it was attempted in accordance with European laid-open document EP 2 404 680 A1 to achieve an improved durability of the piercing mandrel by means of an optimised geometry of the piercing mandrel tip in conjunction with an iron oxide coating. At the same time, it is proposed to avoid friction-induced surface defects on the piercing mandrel by spraying a cooling lubricant through the piercing mandrel tip into the resulting hollow block. For this purpose, the cooling lubricant is directed through the main body of the piercing mandrel via outlet openings, which extend obliquely into the piercing mandrel tip, into the hollow block. To this end, the piercing mandrel tip consists of a cylindrical portion and a hemispherical tip, wherein the outlet openings are disposed in the transition region between the cylindrical portion and the piercing mandrel main body. Disadvantages in this case include the still inadequate cooling of the piercing mandrel tip itself and the inclined position of the outlet openings for the coolant at the piercing mandrel tip which on the one hand is complex to produce and on the other hand no longer reliably prevents closure during the piercing procedure through contact with the material of the round block. Another disadvantage is the one-piece design of the piercing mandrel which in the event of wear requires the entire piercing mandrel to be replaced.

In order to lower the cost of replacing worn piercing mandrels, it has also been proposed in German laid-open document DE 100 24 246 A1 to form the piercing mandrel in two parts with a mandrel nose and a piercing mandrel main body, which can be connected thereto, and for the purpose of increasing durability, to produce the mandrel nose and the main body from different materials corresponding to the thermal and mechanical loadings, and where required to replace only the piercing mandrel tip. A disadvantage in this case is that the mandrel tip is not cooled and the durability is still inadequate specifically in the case of materials which are difficult to work.

Furthermore from the European patent document EP 1 961 497 B1 a further piercing mandrel of a piercing mill is known. This piercing mandrel shows a piercing mandrel nose at a piercing mandrel main body. The piercing mandrel nose is conically broadened seen in the direction of the piercing mandrel main body.

All of these measures have hitherto been unsuitable to effectively reduce the thermal and mechanical loading upon the piercing mandrels during skew rolling such that from an economical and qualitative aspect, sufficiently high durability could be achieved in particular in the case of materials which are difficult to work.

SUMMARY OF THE INVENTION

It is the object of the invention to increase the durability of the piercing mandrel when used for piercing round blocks of metal, in particular higher-alloyed steel materials which are difficult to work, by means of skew rolling whilst taking into account a qualitative improvement of the inner surface of the pierced round block and whilst reducing tool costs.

In accordance with an aspect of the invention, the stated object is achieved by means of a piercing mandrel, having a piercing mandrel nose and a piercing mandrel main body which can be connected to a mandrel bar, which is characterised in that the outer diameter of the piercing mandrel nose is formed in a conically tapering manner in the longitudinal extension towards the piercing mandrel main body. Against expectation, tests have shown that by means of the inversely conical geometry of the mandrel nose or the nose cap it was possible to achieve a significant increase in the durability of the piercing mandrel and at the same time improve the inner surface of the hollow block.

In this case, it is advantageous that the piercing mandrel nose is formed from a nose core, which is connected to the piercing mandrel main body, and from a nose cap which is placed thereover and detachably connected to the nose core. By means of the detachable connection of the nose cap and the nose core, simple and cost-effective replacement can be effected in the event of wear, since it is not the entire piercing mandrel or the mandrel nose with the complexly incorporated coolant supply and discharge lines which has to be replaced but rather only the nose cap which has been most affected by wear and which is simple to produce.

In structural terms, it is advantageous that the mandrel nose for cooling the mandrel nose or the nose core for cooling the nose cap and for lubricating the piercing mandrel is connected to a supply line for cooling lubricant, which passes through the piercing mandrel main body as far as through the mandrel nose or the nose core, and is connected to at least one discharge line, which then guides the cooling lubricant back through the mandrel nose or the nose core, and at the end of the discharge line in the transition region of the piercing mandrel nose and piercing mandrel main body there is disposed an outlet opening to let the cooling lubricant issue out of the piercing mandrel. In combination with the inversely conical geometry of the mandrel nose or the nose cap, it is possible to achieve a significant increase in the durability of the piercing mandrel and at the same time improve the inner surface of the hollow block, since clogging up of the outlet opening disposed precisely in this region and therefore reduced or even completely interrupted cooling are effectively prevented.

The particular geometrical formation of the mandrel nose or the nose cap has significance for increasing the durability of the piercing mandrel or the mandrel nose, in particular when used for piercing steels which are difficult to work and contain more than 5.0 wt. % chromium, wherein the diameter tapers conically towards the mandrel main body, i.e., is formed in an inversely conical manner. Since the diameter of the mandrel main body increases starting from the nose-side end, there is produced in the transition region of the mandrel nose or the nose cap and mandrel main body a "gusset" which is considerably larger in comparison with known piercing mandrels and in which the outlet opening for the cooling lubricant is disposed preferably radially.

During piercing, it is thereby ensured that the outlet opening for the cooling lubricant cannot come into contact with the material of the round block to be pierced, so that clogging of the outlet opening disposed precisely in this region and therefore reduced or even completely interrupted cooling are effectively prevented.

Tests have also shown that by means of this inversely conical geometry of the mandrel nose or the nose cap and the preferably radial arrangement of the outlet opening in the gusset of the transition region of the mandrel nose and the mandrel main body, closure of the outlet opening is effectively prevented, so that sufficient cooling and lubrication of the piercing mandrel and in particular of the nose cap, which is loaded to the greatest extent, is always ensured.

In a particular embodiment, the following conditions are to be maintained for the geometry of the mandrel nose or the nose cap: the length L of the mandrel nose or the nose cap is determined in dependence upon the block diameter DB to be rolled and upon the nose diameter DN on the nose-side end of the mandrel nose or the nose cap, so that the condition $0.10 \times DB \leq L \leq 3 \times DN$ is fulfilled.

It is necessary to fulfil this condition, in order to have a minimum volume and a minimum cross-section available for the mandrel nose or the nose cap, since the inventive cooling of the cap cannot completely prevent heating thereof.

In a particular embodiment, the radius on the nose-side end of the mandrel nose or the nose cap should advantageously have a value of $r \geq 3.0$ mm, in order to avoid load peaks at this transition and thus premature wear.

In a particular embodiment, the angle $\alpha$ required for the inversely conical formation of the mandrel nose or the nose cap should be between 2° and 10°, in order to form a sufficiently large gusset and therefore to achieve the inventive effect of increasing the durability of the piercing mandrel.

A radial arrangement of the outlet opening in the transition region of the mandrel nose and the mandrel main body is advantageous, since they can be manufactured very much more simply in comparison with known, obliquely extending bores. In an advantageous manner, the outlet opening is formed as an annular gap, in order to ensure uniform lubrication over the circumference of the piercing mandrel.

In order to ensure a sufficiently large flow of cooling lubricant through the nose core to the inner side of the nose cap, a sufficiently large axial spacing is to be provided between the face-side end of the nose core and the inner side of the nose cap. The supply line of the cooling lubricant extends preferably centrally through the piercing mandrel to the face-side end of the nose core. The preferably several discharge lines through the nose core lead to the outlet opening from the piercing mandrel in the transition region of the mandrel nose and mandrel main body and are disposed preferably radially about the supply line. Depending upon the diameter of the nose core and the required flow volume of cooling lubricant, e.g. four, six or eight discharge lines can be disposed in the nose core.

In a further improved embodiment of the invention, it is provided that the nose core is also detachably connected to the mandrel main body, so that upon requirement it is necessary to replace only the mandrel main body and not also the nose core having the channels, incorporated therein, for the supply and discharge of cooling lubricant.

In accordance with the invention, connection of the nose core and the mandrel main body can be effected either by means of a screw-connection or, by reason of a simpler assembly and disassembly capability, advantageously by means of a bayonet fitting.

In order to further increase the durability of the piercing mandrel, provision is made in one advantageous development of the invention to provide either only the mandrel nose or the entire piercing mandrel with a coating which reduces heat introduction into the mandrel, e.g. an iron oxide coating. Alternatively or in addition, the mandrel nose and the main body can also consist of different materials which take into account the different loadings during piercing.

Further features, advantages and details of the invention will be apparent from the description hereinafter of the exemplified embodiments illustrated in the enclosed drawings.

DESCRIPTION OF THE PREFERRED EMBODIMENTS

Figure 1:
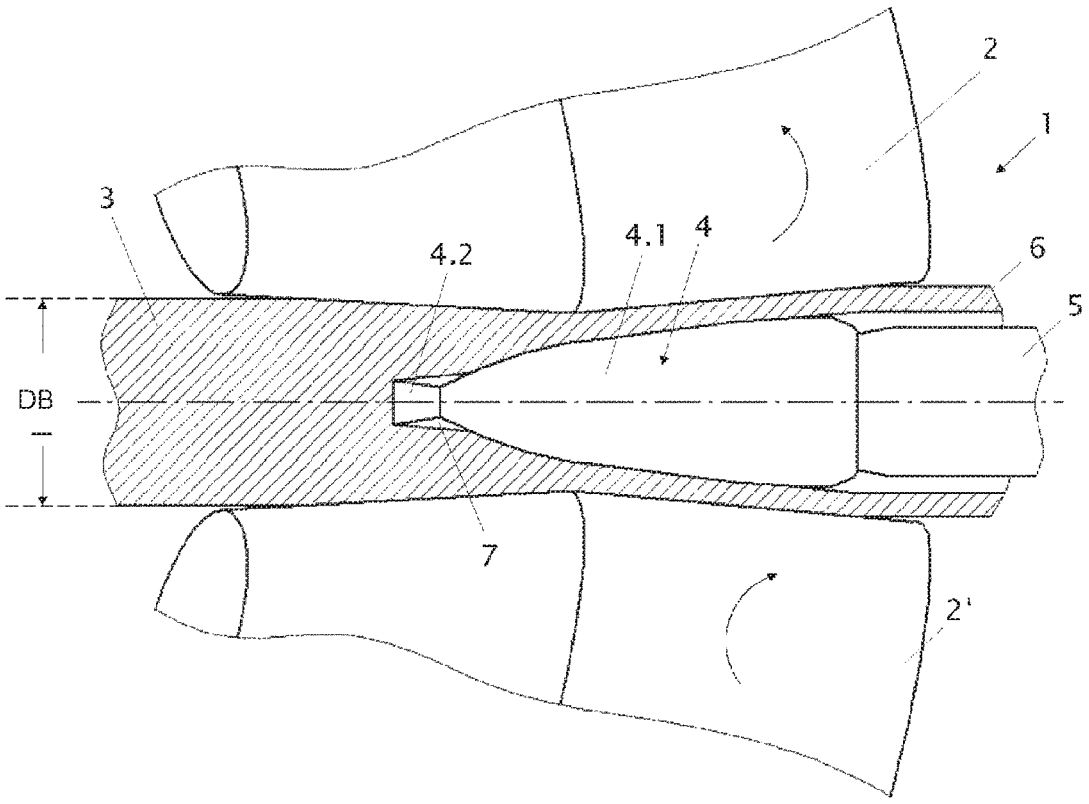
FIG. 1 shows a schematic view of the piercing process in a cone-type piercing mill having a piercing mandrel in accordance with the invention.

FIG. 1 schematically illustrates a cone-type piercing mill which, by means of a piercing mandrel in accordance with the invention, forms a solid steel block into a hollow block pipe. The cone-type piercing mill 1 consists of two working rolls 2, 2' which form the solid block 3 into a hollow block pipe 6 by means of an inner tool which consists of an inventive piercing mandrel 4 and a mandrel bar 5. In the opposite direction of rotation of the working rolls 2, 2', the block 3 or the hollow block pipe 6 is moved in helical line fashion via the axially fixed inner tool.

In accordance with the invention, the piercing mandrel 4 consists of a piercing mandrel main body 4.1, to which a mandrel nose 4.2 is connected. The diameter of the piercing mandrel main body 4.1 increases starting from the nose-side end in a continuous manner up to a maximum value which determines the inner diameter of the hollow block pipe 6. In accordance with the invention, the mandrel nose 4.2 has a diameter which tapers conically with respect to the piercing mandrel main body 4.1, wherein in the transition region from the piercing mandrel main body 4.1 and the piercing mandrel nose 4.2 to the resulting hollow block pipe 6 a gusset 7 is formed which does not come into contact with the material of the hollow block pipe 6 during piercing.

The figure does not illustrate the outlet opening, which is disposed precisely in this gusset or in the transition region, for the cooling lubricant and the cooling of the piercing mandrel.

Figure 2:
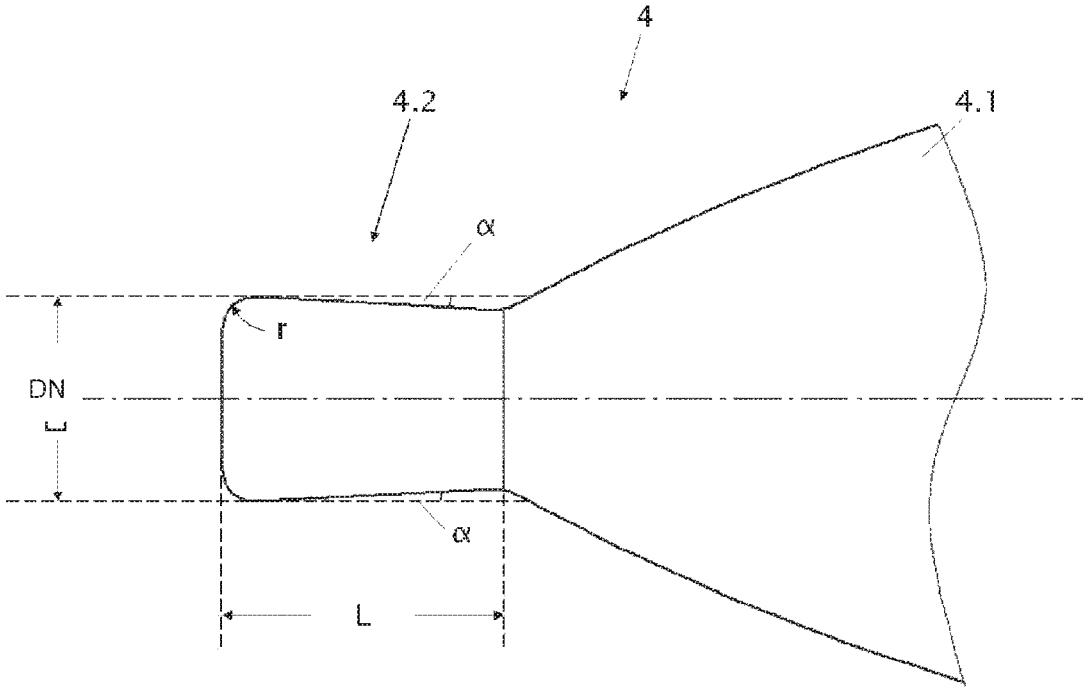
FIG. 2 shows an enlarged schematic view of the piercing mandrel in accordance with the invention.

FIG. 2 shows an enlarged schematic view of the geometrical details of the piercing mandrel 4 in accordance with the invention.

The mandrel nose 4.2 is formed in such a manner as to taper conically towards the piercing mandrel main body 4.1, wherein an angle $\alpha$ between 2° and 10° is maintained. The angle $\alpha$ is formed between the outer surface of the piercing mandrel nose 4.2 and a notional straight line which runs in parallel with a longitudinal axis of the piercing mandrel 4 and is tangential to the outer surface of the piercing mandrel nose 4.2 in the region of its largest diameter DN. The piercing mandrel nose 4.2 has a length L which is dependent upon the diameter of the block 3 (DB) to be pierced and upon the largest diameter of the mandrel nose 4.2 (DN), wherein the condition $0.10 \times DB \leq L \leq 3 \times DN$ is fulfilled. Furthermore, the face-side end of the mandrel nose 4.2 has a radius r which is at least 3 mm.

Figure 3:
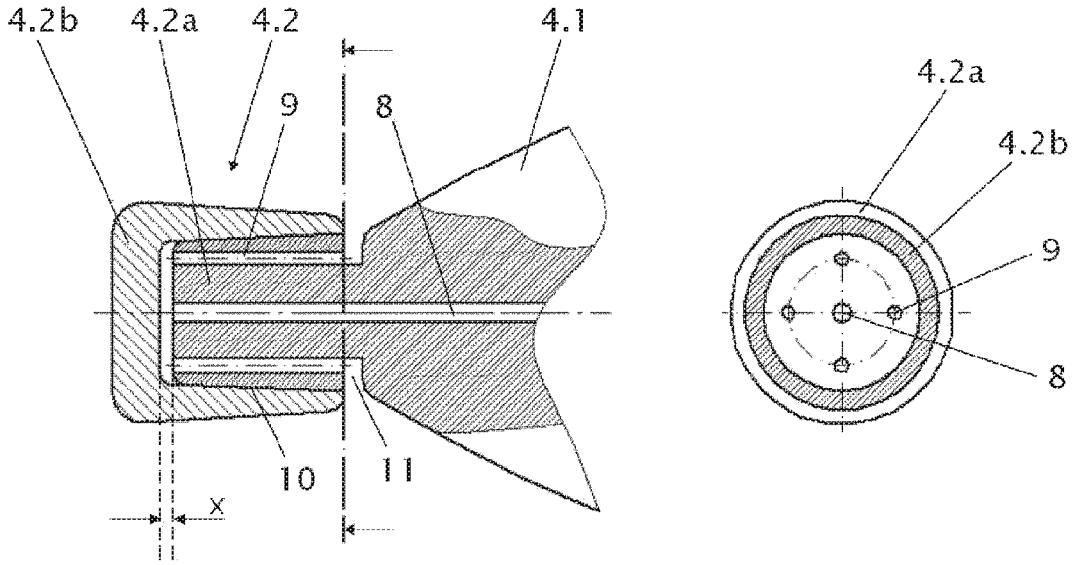
FIG. 3 shows sectional views of a piercing mandrel nose.

FIG. 3 schematically illustrates the formation of the piercing mandrel nose 4.2 in a longitudinal sectional view (partial image on the left) and in a cross-section (partial image on the right). In this example, for a more simplified illustration the piercing mandrel main body 4.1 and the mandrel nose 4.2 are shown in a one-piece, i.e., non-detachable, design. The description hereinafter can also be applied correspondingly to a detachable design.

In the partial image on the left, it is evident that in accordance with the invention the piercing mandrel nose 4.2 consists of a nose core 4.2*a* and a nose cap 4.2*b* placed thereon. In order to achieve a sufficiently large flow volume of cooling lubricant through the piercing mandrel nose 4.2, an axial spacing "x" is provided between the face-side end of the nose core 4.2*a* and the inner side of the nose cap 4.2*b*. In order to maintain the required axial spacing during the piercing procedure, the connection is designed as a cone seat 10, wherein the nose cap 4.2*b* and the nose core 4.2*a* become jammed together by means of the axial pressure exerted upon the nose cap 4.2 during piercing.

The supply line of the cooling lubricant 8 to the nose cap 4.2*b* extends centrally through the piercing mandrel 4 to the face-side end of the nose core 4.2*a*. Also apparent are discharge lines 9 which pass through the nose core 4.2*a* and extend as far as the outlet opening 11—formed as an annular gap—in the transition region of the piercing mandrel nose 4.2 and the mandrel main body 4.1.

The cross-section through the mandrel nose 4.2 as illustrated in the partial image on the right hand side of FIG. 3 shows four discharge lines 9 which are disposed radially in a circular manner around the supply line 8.

LIST OF REFERENCE NUMERALS

1 cone-type piercing mill
2, 2' working rolls
3 solid block
4 piercing mandrel
4.1 piercing mandrel main body
4.2 piercing mandrel nose
4.2*a* nose core
4.2*b* nose cap
5 mandrel bar
6 hollow block pipe
7 gusset
8 cooling lubricant supply line
9 cooling lubricant discharge line
10 cone seat
11 outlet opening
DB diameter of block
DN diameter of nose
L length of the piercing mandrel nose
r radius of the nose cap
$\alpha$ angle

The invention claimed is:

1. Piercing mandrel for piercing heated round blocks of metal for the production of seamless hollow block pipes, the piercing mandrel comprising a piercing mandrel nose and a piercing mandrel main body which can be connected to a mandrel bar, wherein the outer diameter of the piercing mandrel nose is formed in a conically tapering manner in the longitudinal extension towards the piercing mandrel main body, and wherein the piercing mandrel nose and the piercing mandrel main body pierce the round blocks and the diameter of the piercing mandrel main body increases from a nose-side end in a continuous manner up to a maximum value which determines the inner diameter of the hollow block pipes, and wherein the piercing mandrel nose is formed from a nose core, which is connected to the piercing mandrel main body, and from a nose cap which is placed thereover and is detachably connected to the nose core.

2. Piercing mandrel as claimed in claim 1, wherein a supply line for cooling lubricant is connected to the piercing mandrel nose or the nose core, for cooling the piercing mandrel nose or for cooling the nose cap, respectively, and for lubricating the piercing mandrel, wherein said supply line for cooling lubricant passes through the piercing mandrel main body as far as through the piercing mandrel nose or the nose core, and is connected to at least one discharge line, which guides the cooling lubricant back through the piercing mandrel nose or the nose core, and at the end of the discharge line in the transition region of the piercing mandrel nose and piercing mandrel main body there is disposed an outlet opening to let the cooling lubricant issue out of the piercing mandrel.

3. Piercing mandrel as claimed in claim 2, wherein the outlet opening for the cooling lubricant extends in a radial direction with respect to the longitudinal axis of the piercing mandrel.

4. Piercing mandrel as claimed in claim 3, wherein the outlet opening is formed as an annular gap between the piercing mandrel nose and the piercing mandrel main body.

5. Piercing mandrel as claimed in claim 4, wherein the supply line of the cooling lubricant extends centrally through the piercing mandrel as far as the face-side end of the nose core.

6. Piercing mandrel as claimed in claim 3, wherein the supply line of the cooling lubricant extends centrally through the piercing mandrel as far as the face-side end of the nose core.

7. Piercing mandrel as claimed in claim 2, wherein the outlet opening is formed as an annular gap between the piercing mandrel nose and the piercing mandrel main body.

8. Piercing mandrel as claimed in claim 2, wherein the supply line of the cooling lubricant extends centrally through the piercing mandrel as far as the face-side end of the nose core.

9. Piercing mandrel as claimed in claim 1, wherein the length L of the piercing mandrel nose satisfies the requirement $0.10 \times DB \leq L \leq 3 \times DN$, wherein DB is the diameter of the round block to be pierced and DN is the diameter of the front end of the piercing mandrel nose.

10. Piercing mandrel as claimed in claim 1, wherein the radius at the front end of the piercing mandrel nose is at least 3 mm.

11. Piercing mandrel as claimed in claim 1, wherein the angle $\alpha$ of the conical tapering of the piercing mandrel nose satisfies the requirement $2° \leq \alpha \leq 10°$.

12. Piercing mandrel as claimed in claim 1, wherein the nose core and the nose cap are connected via a cone seat which itself becomes jammed under axial pressure.

13. Piercing mandrel as claimed in claim 1, wherein the piercing mandrel nose and the piercing mandrel main body are detachably connected together.

14. Piercing mandrel as claimed in claim 13, wherein the piercing mandrel nose and the piercing mandrel main body are connected together by means of a screw-connection.

15. Piercing mandrel as claimed in claim 13, wherein the piercing mandrel nose and the piercing mandrel main body are connected together by means of a bayonet fitting.

16. Piercing mandrel as claimed in claim 1, wherein the piercing mandrel nose and the piercing mandrel main body consist of different metallic materials.

17. Piercing mandrel as claimed in claim 1, wherein the piercing mandrel nose and/or the piercing mandrel main body are provided with a coating which reduces heat introduction into the piercing mandrel.

18. Piercing mandrel as claimed in claim 17, wherein the coating is a iron oxide coating.

* * * * *